United States Patent [19]

Pearson

[11] 4,017,916

[45] Apr. 19, 1977

[54] TOILET VENTILATOR INCLUDING MOTION-RESPONSIVE ELECTRICAL TRANSDUCER

[76] Inventor: Raymond H. Pearson, 627 Sherwood Drive, Richardson, Tex. 75080

[22] Filed: Dec. 4, 1975

[21] Appl. No.: 637,646

Related U.S. Application Data

[63] Continuation-in-part of Ser. No. 540,538, Jan. 13, 1975, Pat. No. 3,942,400, which is a continuation-in-part of Ser. No. 496,954, Aug. 13, 1974, Pat. No. 3,939,506.

[52] U.S. Cl. ..... 4/213; 4/67 R; 4/DIG. 3

[51] Int. Cl.[2] ..... E03D 9/04; A47K 13/00

[58] Field of Search ..... 4/213, 217, 209, 100, 4/DIG. 3, 211, 218, 67 R

[56] References Cited

UNITED STATES PATENTS

| | | | |
|---|---|---|---|
| 1,342,716 | 6/1920 | Johnston | 4/213 |
| 2,056,087 | 9/1936 | Andrews | 4/67 R |
| 2,061,310 | 11/1936 | Kleiser, Jr. | 4/67 R |
| 2,100,962 | 11/1937 | Juntunen | 4/213 |
| 2,105,794 | 1/1938 | Norris | 4/213 |
| 2,279,789 | 4/1942 | Jentzer | 4/213 |
| 2,778,033 | 1/1957 | Majauskas | 4/213 |
| 2,985,890 | 5/1961 | Baither | 4/213 |
| 3,087,168 | 4/1963 | Huso | 4/213 |
| 3,102,275 | 9/1963 | Raymond | 4/213 |
| 3,192,539 | 7/1965 | Martz | 4/218 |
| 3,495,282 | 2/1970 | Taggart | 4/213 |

*Primary Examiner*—Henry K. Artis

[57] ABSTRACT

A ventilator for toilets is disclosed which includes an air duct to receive and remove the odorous air, an air suction device to establish the odorous air flow, a control for initiating and terminating the odorous air flow, and an electrical transducer responsive to the motion of the toilet flushing mechanism so as to terminate the air flow at the moment the toilet is flushed.

2 Claims, 6 Drawing Figures

TOILET VENTILATOR INCLUDING MOTION-RESPONSIVE ELECTRICAL TRANSDUCER

CROSS REFERENCE TO RELATED APPLICATION

This is a continuation-in-part of my pending application Ser. No. 540,538, filed Jan. 13, 1975, now U.S. Pat. No. 3,942,400. Application Ser. No. 540,538 is in turn a continuation-in-part of pending application Ser. No. 496,954, now U.S. Pat. No. 3,939,506, filed Aug. 13, 1974.

BACKGROUND OF THE INVENTION

1. Field of the Invention

This invention relates to a ventilator system for removing odorous air from toilet bowls, and more particularly to the type of toilet ventilators which include an air duct in communication with odorous air within the toilet, an air suction device, and automatic electrical control for terminating the ventilation when the toilet is flushed.

2. Description of the Prior Art

In addition to applicants aforementioned pending applications, others have disclosed toilet ventilators which include automatic controls for terminating ventilation when the toilet is flushed. The following patents are illustrative: U.S. Pat. Nos. 1,342,716; and 2,881,450.

U.S. Pat. No. 1,342,716 teaches a normally open switch which is automatically closed when the toilet seat is occupied, initiating the ventilator. A special linkage engages the water valve float within the water tank when the water level falls to a predetermined level after flushing the toilet. This causes the switch to open, terminating the ventilation.

U.S. Pat. No. 2,881,450 teaches a switch which is operated by an auxiliary float which senses the water level within the water tank. When the toilet is flushed, the water level falls, and the switch is operated at a predetermined water level, terminating the ventilation.

Advantages Over the Prior Art

A problem develops when the method of a float operated switch is employed in toilet ventilators of the prefered type in which the water tank air pressure is reduced below atmospheric pressure, by means of an air suction device, so as to cause odorous air to flow from the toilet bowl via the water tank overflow duct. With the float operated switch, there is necessarily a time delay between the flushing of the toilet and the termination of ventilation, because the water level must fall in order for the float to operate the switch. The air suction remains applied during this interval, and retards the normal rapid flushing cycle of the toilet, inasmuch as the air suction subtracts from the water head in the water tank. The present invention eliminates this time lag, and the resulting problem, by means of an electrical transducer which is responsive to the motion of the flushing mechanism, whereby ventilation is terminated at the moment the toilet is flushed. The invention is suitable for use with all known types of electrically controlled toilet ventilators. It is also less costly, more reliable, and requires less maintenence than the aforementioned prior art.

SUMMARY OF THE INVENTION

It is an object of this invention to provide an improved ventilator for toilets.

It is another object of this invention to provide an improved toilet ventilator which is less costly, and more reliable than previous similar types.

It is still another object of this invention to provide immediate automatic termination of the ventilation when the toilet is flushed, in a manner which insures that the normal rapid flushing cycle of the toilet will not be retarded.

It is yet another object of this invention to provide for the immediate automatic termination of the toilet ventilation by a means which is responsive to the motion of the flushing mechanism.

BRIEF DESCRIPTION OF THE DRAWINGS

With the foregoing objects and features in view, and such other objects and features which may become apparent as this specification proceeds, the invention will be understood from the following description, taken in conjunction with the accompanying drawings, in which like characters of reference are used to designate like parts and in which.

DESCRIPTION OF THE PREFERRED EMBODIMENTS

Figure 1:
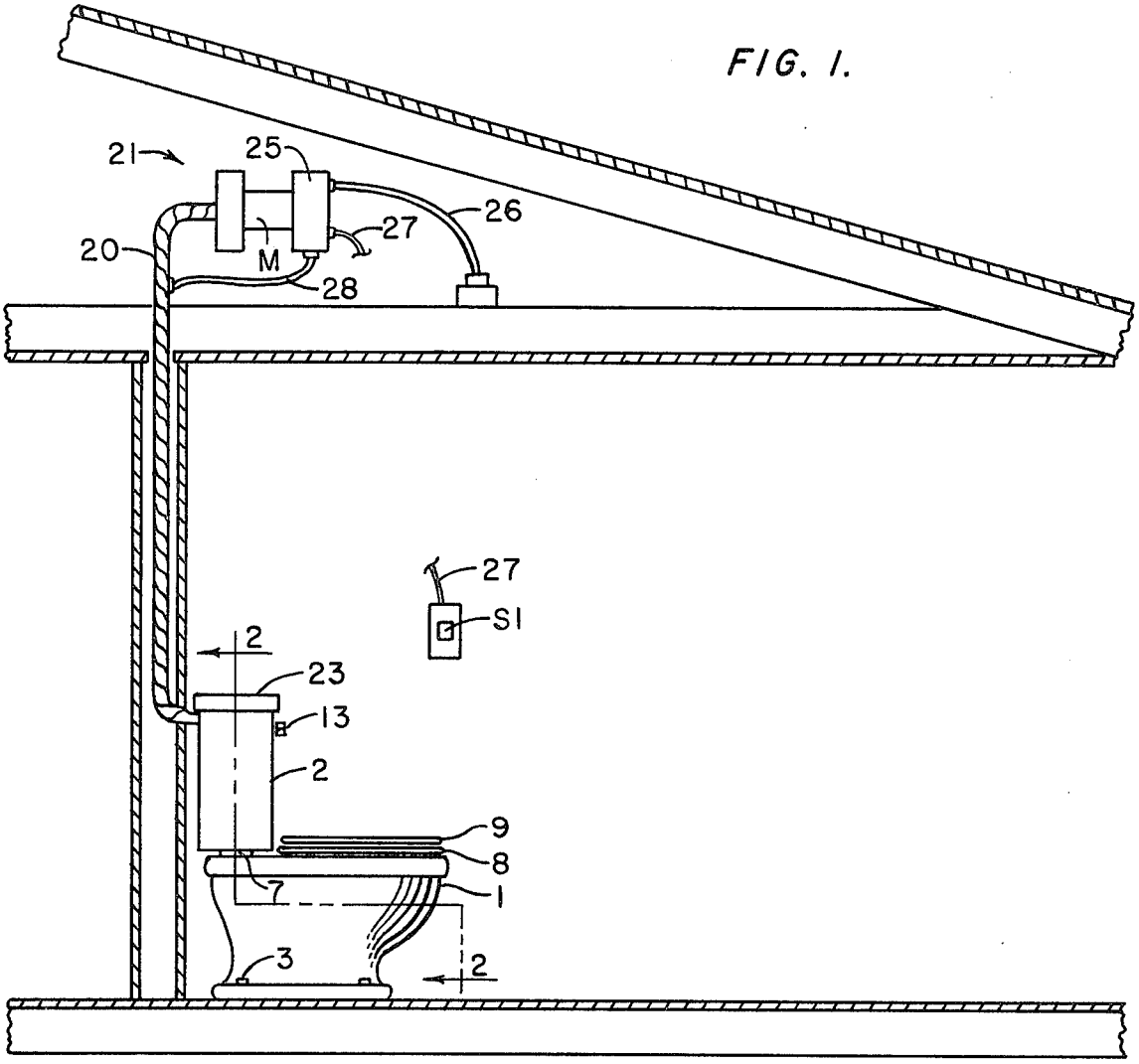
FIG. 1 is a side elevation view, whown partially in section, of a toilet equipped with the preferred ventilator, and located adjacent to a wall.
Figure 2:
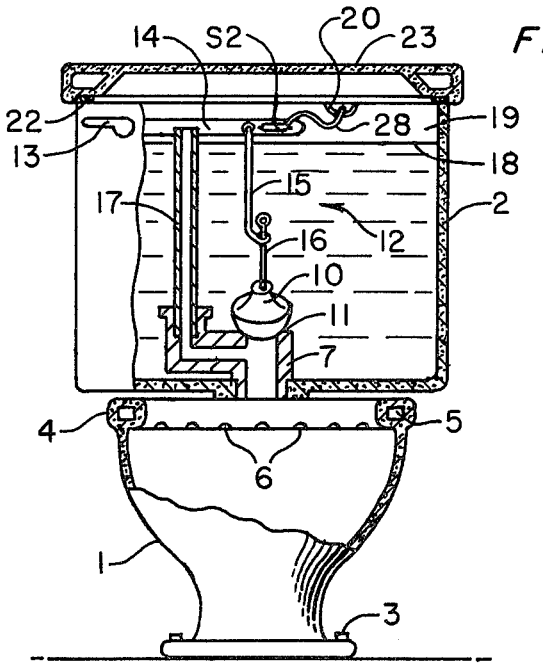
FIG. 2 is a front elevation view of the toilet bowl and water tank whown in FIG. 1, with a portion of the bowl and water tank shown in vertical cross section waken along line 2—2 in FIG. 1, showing typical toilet detail together with a mercury switch which is responsive to the motion of the flushing mechanism.

Referring to the drawings in detail, and particularly to FIGS. 1 and 2, there is illustrated a toilet ventilator which is adapted to a conventional water closet including a bowl 1 and water tank 2. The toilet bowl 1 is conventionally bolted to the bathroom floor by bolts 3. The top of the toilet bowl 1 includes a hollow rim 4 which defines a flush-water distribution channel 5, having water distribution holes 6 around the bottom edge. The water tank 2 is seated on the rear of the bowl 1, or integral therewith, and is connected by means of a water discharge conduit 7 to a mating aperture (not shown) in the hollow rim 4. On top of the bowl 1, the usual seat 8 and cover 9 are provided. Some of the customary internal water tank hardware is shown including a ball flushing valve 10, which is shown in the closed position seated on the ball flushing valve seat 11 at the upper terminus of the water discharge conduit 7. The ball flushing valve 10 is adapted in the conventional manner to be lifted upon manual operation of the flushing mechanism 12, comprised of a flushing handle 13, lever 14, linkage 15, and rod 16, whereupon water flows from the tank 2, through the water discharge conduit 7, into the water distribution channel 5, and out through the water distribution holes 6 so as to flush the toilet bowl 1. Other types of flushing valves, such as those which are hinged, are perfectly suitable also. An overflow duct 17 is connected into the water discharge conduit 7, or integral therewith, at a point beneath the ball flushing valve 10. It will be understood that the water tank 2 also includes the usual inlet water pipe and automatic tank filling valve (not shown), so as to refill the water tank 2 to a predetermined level 18 after each flushing cycle. The water level 18 is in all cases below the upper terminus of the overflow duct 17. An air space 19 is always provided above the water line 18.

The preferred embodiment of the toilet ventilator includes an air duct 20 communicatively connected into the air space 19, and an air suction device 21, which is usually an electric blower. When the ventilator is initiated, odorous air flows in seriatim from the toilet bowl 1, through the water distribution holes 6, through the water distribution channel 5, through the water discharge conduit 7, through the overflow duct 17, through the air space 19, through the air duct 20, and is discharged into the atmosphere by the air suction device 21. A seal 22 is usually provided between the upper rim of the water tank 2 and the water tank cover 23, so as to effect a more efficient flow of air through the toilet bowl 1. An electrical switch S1 is preferably mounted in the bathroom wall, for the purpose of initiating the ventilator.

It will be understood that the preferred embodiment reduces the pressure of the water tank air space 19, causing the aforementioned odorous air flow. The pressure of the air space is commonly reduced by 1 to 2 inches of water below atmospheric pressure when the ventilator is in use. When the toilet is flushed, water immediately floods the overflow duct 17, effectively blocking the odorous air flow through it. At this time the pressure of the air space 19 falls to that of the air suction device intake side, which is usually about 4 to 6 inches of water below atmospheric pressure. It will be appreciated that the water head in the water tank is normally only about 8 to 10 inches, and the sudden decrease in air pressure greatly retards the flow of water from the water tank. The retarded flushing cycle is unsanitary, and a nuisance. As a remedy, I have invented the ventilator control system which is responsive to the motion of the flushing mechanism 12 when the toilet is flushed. The present invention provides a means whereby large suctions may be employed for effective odor control, ventilation is automatically terminated at the moment the toilet is flushed, and the flushing cycle is perfectly normal.

Figure 3:
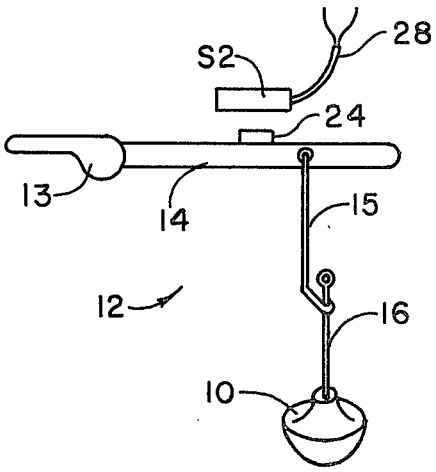
FIG. 3 is a diagrammatic view whowing a typical flushing mechanism together with a magnet and reed switch which is responsive to the motion of the flushing mechanism.

In the preferred embodiment, an electrical switch S2 is connected to the flushing mechanism 12 as to be responsive to the motion of the mechanism when the toilet is flushed. FIG. 2 portrays a normally closed mercury switch S2 connected to the lever 14 so as to open when the lever 14 moves from its rest position as the toilet is flushed. FIG. 3 portrays a normally closed reed switch S2, suitably fastened to the tank wall or other supporting means, which is opened as the permanent magnet 24 is moved near to it during the flushing of the toilet. A mechanical switch (not shown) may be suitably linked to the flushing mechanism 12 if so desired. The actuating schemes described above are by no means exhaustive, and the only requirement is that the motion of the flushing mechanism 12 causes the switch S2 to open or close as determined by the electrical circuit employed.

In addition to initiating the odorous air flow, it is highly desirable that the control means also be capable of stopping the suction rapidly, and of venting the water tank air space to the atmosphere when the switch S2 terminates the ventilation. Applicant has disclosed techniques of employing brakes and valves for accomplishing these control functions in the aforementioned pending applications. The control techniques taught therein are easily adapted to the current invention.

Figure 4:
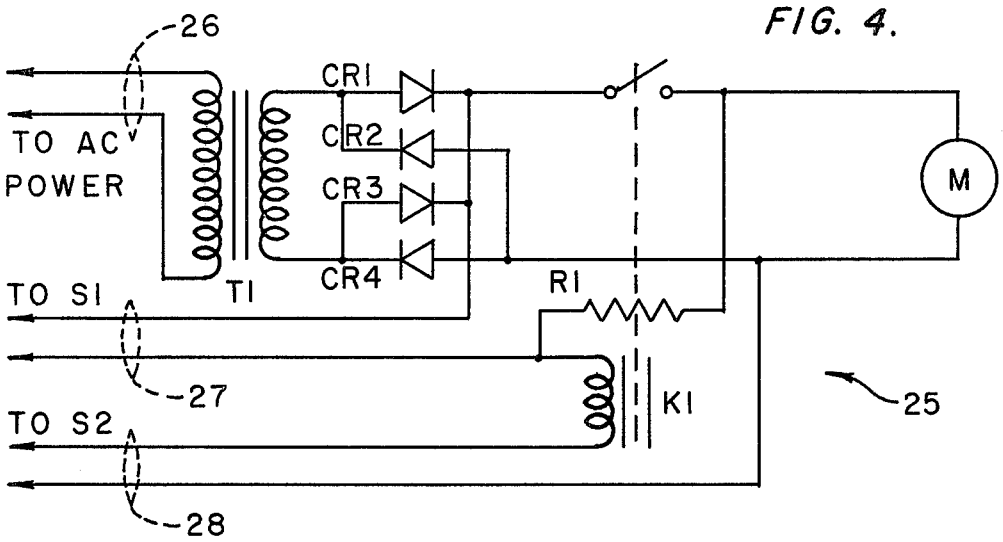
FIG. 4 is the schematic diagram of an electrical circuit suitable for this invention when the motion-responsive electrical transducer is an electrical switch.

A suitable electrical circuit 25, for the preferred embodiment containing a switch as the motion-responsive electrical transducer, is shown in FIG. 4. An electrical cable 26 connects to a convenient power source, usually 120 volts 60 Hertz. A second electrical cable 27 connects to the aforementioned wall switch S1. A third electrical cable 28 connects to the aforementioned switch S2, which is responsive to the motion of the flush mechanism 12, via the air duct 20. Switch S1 is a normally open momentary contact switch. When the switch S1 is momentarily closed so as to initiate the ventilator, the relay K1 closes, causing the air suction device 21 to start. In the preferred embodiment, the air suction device 21 is an electric blower, but most any type of air suction device is adaptable. The relay K1 latches closed through a resistor R1. When the flushing mechanism 12 is actuated to flush the toilet, the switch S2 opens as described above. This allows the relay K1 to unlatch, which removes power from the blower motor M, terminating the ventilation, and allowing a normal rapid flushing cycle. Other types of air suction devices may require the use of electrically controlled valves or other air control means to terminate the air flow. A transformer T1 is provided so as to reduce the voltage appearing on the switch S2 to a level which will not cause problems due to the high humidity within the water tank air space 19. Rectifiers CR1, CR2, CR3, and CR4 permit the use of a high speed DC blower motor M. This is of course optional, and the rectifiers may be omitted if an AC motor is employed. The electrical circuit 25 is by no means exhaustive, and other feasible circuits may be designed by those skilled in the art.

Figure 5:
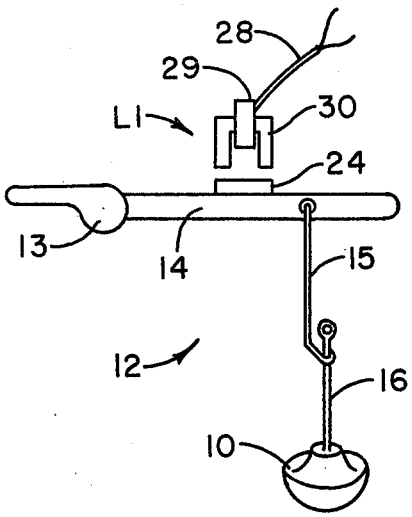
FIG. 5 is a diagrammatic view showing a typical flushing mechanism together with an iron core inductor and magnet which generates a voltage pulse in response to the motion of the flushing mechanism.

As an alternative to the preferred embodiment, FIG. 5 portrays a typical flushing mechanism 12 in combination with an iron core inductor L1, which is stationary and may be fastened to the water tank 2 in any convenient manner. As in FIG. 3, a permanent magnet 24 is fastened to the flushing mechanism 12, in this case to the lever 14. It will be observed that the inductor coil 29 is supported by a U-shaped iron core 30, which may be silicon steel laminations. The open side of the U-shaped iron core 30 is turned toward the magnet 24. When the toilet is flushed, the magnet 24 suddenly moves toward the inductor L1, generating a voltage pulse across the inductor coil 29 in response to the motion of the flushing mechanism 12. This voltage pulse is used to terminate the ventilation, in conjunction with a suitable electronic circuit. The iron core inductor/permanent magnet combination is a reliable approach, but is more expensive than the preferred embodiment which contains an electrical switch as the motion-responsive electrical transducer.

Figure 6:
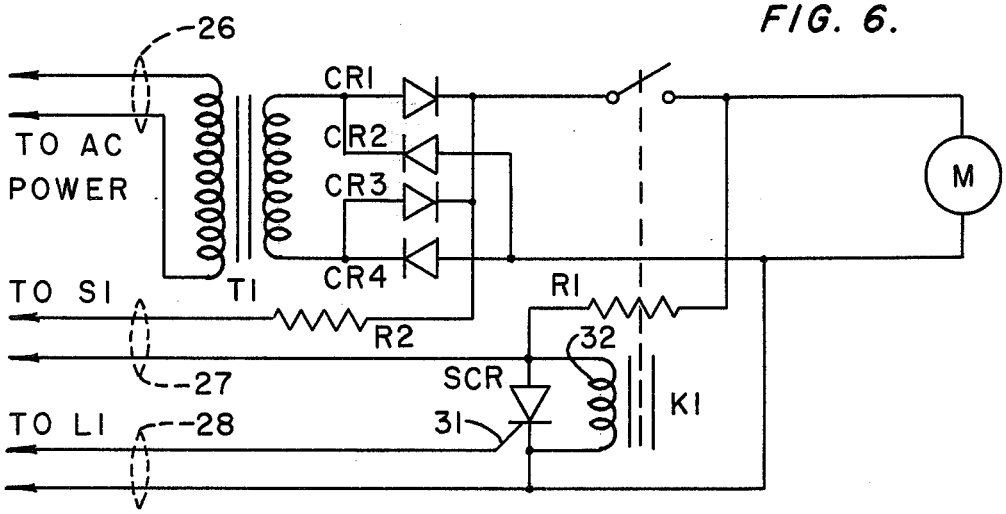
FIG. 6 is the schematic diagram of an electrical circuit suitable for this invention when the motion-responsive electrical transducer is an iron core inductor.

FIG. 6 is the schematic of an electrical circuit which is suitable for use with the alternate method containing the inductor L1. The circuit is similar to that of FIG. 4 except that a sensitive-gate thyrister SCR, and a resistor R2, have been added. Switch S1 initiates the ventilator as before, causing the relay K1 to latch on. When the toilet is flushed, a voltage pulse from the inductor L1 appears on the gate 31, causing the thysister SCR to conduct. This of course shunts the relay coil 32, causing the relay K1 to unlatch, which terminates the ventilation. The resistor R2 protects the thyrister SCR from damaging current in the unlikely event that the switch S1 is closed at the same time the toilet is flushed.

Many other electrical transducers, which are responsive to the motion of the flushing mechanism 12, may be employed by those skilled in the art. Piezoelectric transducers, photoelectric devices, strain gage elements, seismometers, and other such devices are feasible, though in some cases expensive.

While the preferred embodiment is an especially good toilet ventilator, it will be understood that the invention disclosed herein is suitable for use with many other toilet ventilator configurations. In fact it is adaptable to all known types of electrically controlled toilet ventilators. The air duct 20 may be optionally connected directly into the overflow duct 17, toilet bowl 1, or toilet seat 8 as taught in the art. Toilet-mounted ventilators employing short, integral air ducts are especially suitable for use with the present invention. These usually contain an integral odor filter material such as activated charcoal, and recirculate freshened air back into the bathroom as taught in the art.

The invention as disclosed may be modified without departing from the principles and scope of the invention, and it is not desired to limit the invention to the exact construction shown and described herein.

What is claimed is:

1. A deodorizing accessary for water closets, said water closet including a toilet bowl and water tank, said water tank including a flushing mechanism having an external operating appendage disposed on the outside of said water tank, said accessary comprising electric air blower means suitably communicative with said water closet so as to remove odorous air from said toilet bowl, and control means, said control means including switching means operable to initiate said air blower means, said control means also including electrical transducer means responsive to the motion of said flushing mechanism, said electrical transducer means having at least one parameter which is a function of said motion, whereby said air blower means may be terminated in response to the motion of said flushing mechanism when said water closet is flushed.

2. The invention as set forth in claim 1, said switching means also operable to terminate said air blower means.

* * * * *